US009771802B2

(12) United States Patent
Ross et al.

(10) Patent No.: US 9,771,802 B2
(45) Date of Patent: Sep. 26, 2017

(54) THERMAL SHIELDS FOR GAS TURBINE ROTOR

(71) Applicant: Siemens Energy, Inc., Orlando, FL (US)

(72) Inventors: Christopher W. Ross, Oviedo, FL (US); Bulent Acar, Ankara (TR)

(73) Assignee: SIEMENS ENERGY, INC., Orlando, FL (US)

( * ) Notice: Subject to any disclaimer, the term of this patent is extended or adjusted under 35 U.S.C. 154(b) by 705 days.

(21) Appl. No.: 14/189,147

(22) Filed: Feb. 25, 2014

(65) Prior Publication Data

US 2015/0240644 A1 Aug. 27, 2015

(51) Int. Cl.

| | |
|---|---|
| ***F01D 5/08*** | (2006.01) |
| ***F01D 25/12*** | (2006.01) |
| ***F01D 5/06*** | (2006.01) |
| ***F01D 11/00*** | (2006.01) |

(52) U.S. Cl.

CPC ..... *F01D 5/082* (2013.01); *F01D 5/06* (2013.01); *F01D 5/085* (2013.01); *F01D 11/006* (2013.01); *F01D 25/12* (2013.01); *F05D 2240/24* (2013.01); *F05D 2250/75* (2013.01)

(58) Field of Classification Search

CPC ..... F01D 5/087; F01D 5/066; F01D 11/008; F01D 5/082; F01D 5/06; F01D 5/085; F01D 11/006; F01D 25/12

See application file for complete search history.

(56) References Cited

U.S. PATENT DOCUMENTS

| | | | | |
|---|---|---|---|---|
| 5,310,319 | A | 5/1994 | Grant et al. | |
| 5,611,669 | A | 3/1997 | Royle | |
| 5,842,831 | A | 12/1998 | Galke et al. | |
| 6,416,276 | B1 | 7/2002 | Marmilic et al. | |
| 7,476,078 | B2 | 1/2009 | Doebbeling et al. | |
| 8,033,784 | B2 | 10/2011 | Bachofner et al. | |
| 2010/0178160 | A1* | 7/2010 | Liotta | F01D 5/066 415/173.7 |

FOREIGN PATENT DOCUMENTS

| | | | |
|---|---|---|---|
| CN | 101845996 | A | 9/2010 |
| EP | 0169798 | A1 | 1/1986 |
| EP | 1217169 | A2 | 6/2002 |
| EP | 1780380 | A2 | 5/2007 |
| EP | 2060741 | A2 | 5/2009 |
| EP | 2208860 | A2 | 7/2010 |

* cited by examiner

*Primary Examiner* — Christopher Besler

(57) ABSTRACT

A turbomachine including a rotor having an axis and a plurality of disks positioned adjacent to each other in the axial direction, each disk including opposing axially facing surfaces and a circumferentially extending radially facing surface located between the axially facing surfaces. At least one row of blades is positioned on each of the disks, and the blades include an airfoil extending radially outward from the disk A non-segmented circumferentially continuous ring structure includes an outer rim defining a thermal barrier extending axially in overlapping relation over a portion of the radially facing surface of at least one disk, and extending to a location adjacent to a blade on the disk A compliant element is located between a radially inner circumferential portion of the ring structure and a flange structure that extends axially from an axially facing surface of the disk.

4 Claims, 5 Drawing Sheets

THERMAL SHIELDS FOR GAS TURBINE ROTOR

STATEMENT REGARDING FEDERALLY SPONSORED DEVELOPMENT

Development for this invention was supported in part by Contract No. DE-FC26-05NT42644, awarded by the United States Department of Energy Accordingly, the United States Government may have certain rights in this invention.

FIELD OF THE INVENTION

The present invention relates to turbomachines and, more particularly, to a thermal shield for rotors in turbomachines.

BACKGROUND OF THE INVENTION

A gas turbine engine generally includes a compressor section, a combustor section, a turbine section and an exhaust section. In operation, the compressor section may induct ambient air and compress it The compressed air from the compressor section enters one or more combustors in the combustor section The compressed air is mixed with the fuel in the combustors, and the air-fuel mixture can be burned in the combustors to form a hot working gas. The hot working gas is routed to the turbine section where it is expanded through alternating rows of stationary airfoils and rotating airfoils and used to generate power that can drive a rotor. The expanded gas may then exit the engine through the exhaust section.

During operation of the engine, various components in the engine are subjected mechanical and thermal stresses that may reduce the mechanical integrity of the components over a period of engine operating time In the compressor section, areas of the rotor that are not covered by the blades may be protected by thermal shields. The thermal shields are typically formed as segments supported at individual mounting points on the rotor for retaining the segments in circumferential and radial positions around the circumference of the rotor.

SUMMARY OF THE INVENTION

In accordance with an aspect of the invention, a turbomachine is provided comprising a rotor having an axis and a plurality of disks positioned adjacent to each other in the axial direction, each disk including opposing axially facing surfaces At least one row of blades is positioned on each of the disks, each row of blades extending radially outward from a radially facing surface of a respective disk. A circumferentially continuous ring structure defines a thermal barrier extending axially between and overlapping the radially facing surfaces of two adjacent disks. A compliant element is located between a radially inner circumferential portion of the ring structure and an axially extending flange structure of one of the disks.

The ring structure may have an outer axially extending rim, a radially inner foot portion forming the radially inner circumferential portion of the ring structure, and a radially extending web that is axially narrower than and forms a connection between the rim and the foot portion wherein the compliant element can movably support the foot portion on the flange structure.

A retention plate structure may be detachably fastened to the disk to engage the foot portion for axially retaining the ring structure to the flange structure.

The foot portion may include an axial extension for engagement with an axially facing surface of the disk.

The axial extension may form an anti-rotation feature having circumferentially facing surfaces located in engagement with cooperating circumferentially facing surfaces formed on the facing surface of the disk.

Axially extending air passages may extend through the compliant element to provide passage of air between the foot portion and the flange structure, and the ring structure can include an outer rim having edges located adjacent to edges of the blades, wherein a gap may be defined between the adjacent edges of the outer rim and the blades for passage of a cooling air flow from a radially inner to a radially outer location relative to the outer rim.

The compliant element may be a circular wave spring.

The disks may be formed of a first material and the ring structure may be formed of a second material, which shields the radially facing surfaces of the disks from the temperature of a hot gas passing through an axial gas flow path containing the blades, and the second material may have a higher heat resistance than the first material.

The compliant element may be located at one of. a) between a radially inward facing side of the ring structure and a radially outward facing side of the flange structure, and b) between a radially outward facing side of the ring structure and a radially inward facing side of the flange structure.

In accordance with another aspect of the invention, a turbomachine is provided comprising a rotor having an axis and a plurality of disks positioned adjacent to each other in the axial direction, each disk including opposing axially facing surfaces and a circumferentially extending radially facing surface located between the axially facing surfaces At least one row of blades is positioned on each of the disks, the blades including a platform extending axially across a portion of the radially facing surface of a respective disk, and the blades including an airfoil extending radially outward from the platform. A non-segmented circumferentially continuous ring structure includes an outer rim defining a thermal barrier extending axially from an edge of a first platform on a first disk to an edge of a second platform on an adjacent second disk The outer rim overlaps a portion of the radially facing surfaces of the two adjacent disks. A compliant element is located between a radially inner circumferential portion of the ring structure and a flange structure that extends axially from an axially facing surface of one of the disks.

The radially inner circumferential portion of the ring structure may be formed by a foot portion that is connected to the outer rim by a web, defining a generally T-shaped cross-section for the ring structure, and the web extends radially in axially spaced relation from adjacent axially facing surfaces of the adjacent disks.

The ring structure may be non-rigidly supported to one of the disks to permit cooling air to flow radially outward along either side of the web, from the foot portion to the outer rim, and through gaps between the outer rim and the edges of the first and second platforms into an axial gas flow path of the turbomachine.

The compliant element may maintain air passages therethrough to permit the cooling air to pass from one side of the web to the other The compliant element may permit a circumference of the ring structure to move radially relative to a circumference of the disk.

The ring structure may be assembled to the flange structure of the disk by axial movement of the ring structure relative to the disk, and the ring structure may be retained to the disk by a retention plate structure detachably fastened to the disk.

In accordance with a further aspect of the invention, a turbomachine is provided comprising a rotor having an axis and a plurality of disks positioned adjacent to each other in the axial direction, each disk including opposing axially facing surfaces and a circumferentially extending radially facing surface located between the axially facing surfaces At least one row of blades is positioned on each of the disks, and the blades include an airfoil extending radially outward from the disk. A non-segmented circumferentially continuous ring structure includes an outer rim defining a thermal barrier extending axially in overlapping relation over a portion of the radially facing surface of at least one disk, and extending to a location adjacent to a blade on the disk. A compliant element is located between a radially inner circumferential portion of the ring structure and a flange structure that extends axially from an axially facing surface of the disk.

The radially inner circumferential portion of the ring structure may be formed by a foot portion that is connected to the outer rim by a web, and the web extends radially in axially spaced relation from the axially facing surface of the disk.

The ring structure can be non-rigidly supported to the disk to permit cooling air to flow radially in a space between the web and the axially facing surface, from the foot portion to the outer rim, and through a gap between the outer rim and the blade into an axial gas flow path of the turbomachine.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
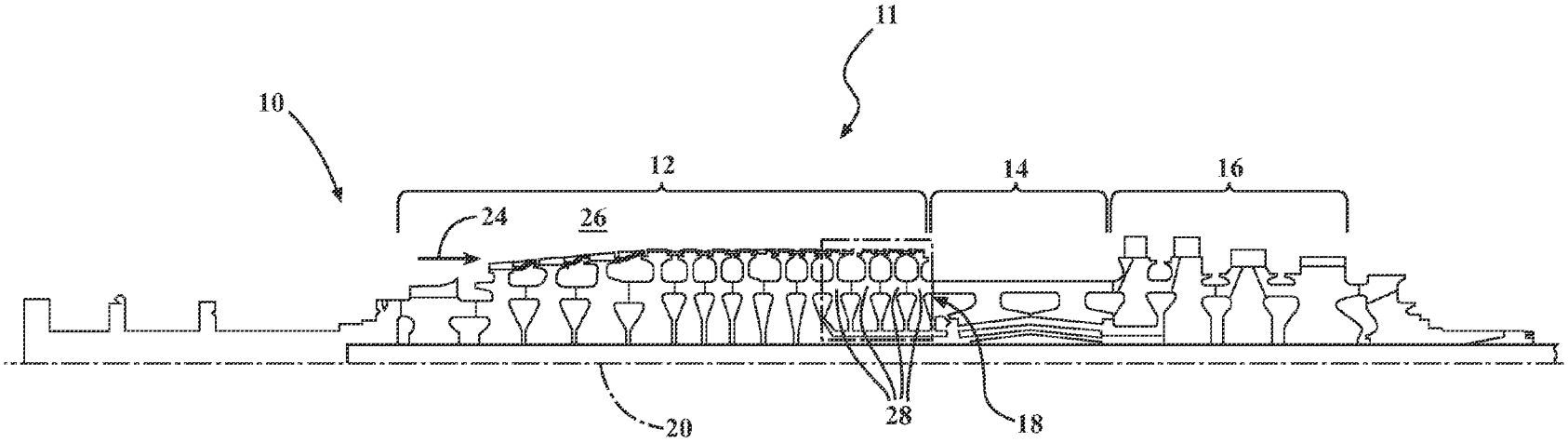
FIG. 1 is a partial cross-sectional view of a turbine engine illustrating aspects of the present invention.

Referring to FIG. 1, a rotor 10 of a turbomachine 11, depicted herein as a gas turbine engine, is illustrated and includes a compressor section 12, a middle section 14 extending through a combustor section of the engine, and a turbine section 16 The rotor 10 is supported for rotation about a rotor axis 20 wherein the rotor 10 rotates in response to hot gases provided from combustors (not shown) in the middle section 14 expanding through the turbine section 16 Rotation of the rotor 10 causes blades 22 (FIG. 2) in the compressor section 12 to rotate and compress air through successive stages of the compressor section 12 An identified section 18 of the compressor section 12 identifies the high pressure and output stages of the compressor section 12 where the air, flowing in the direction 24 through a flow path 26 defined between an outer wall (not shown) and the rotor 10, comprises a highly compressed relatively hot gas.

Figure 2:
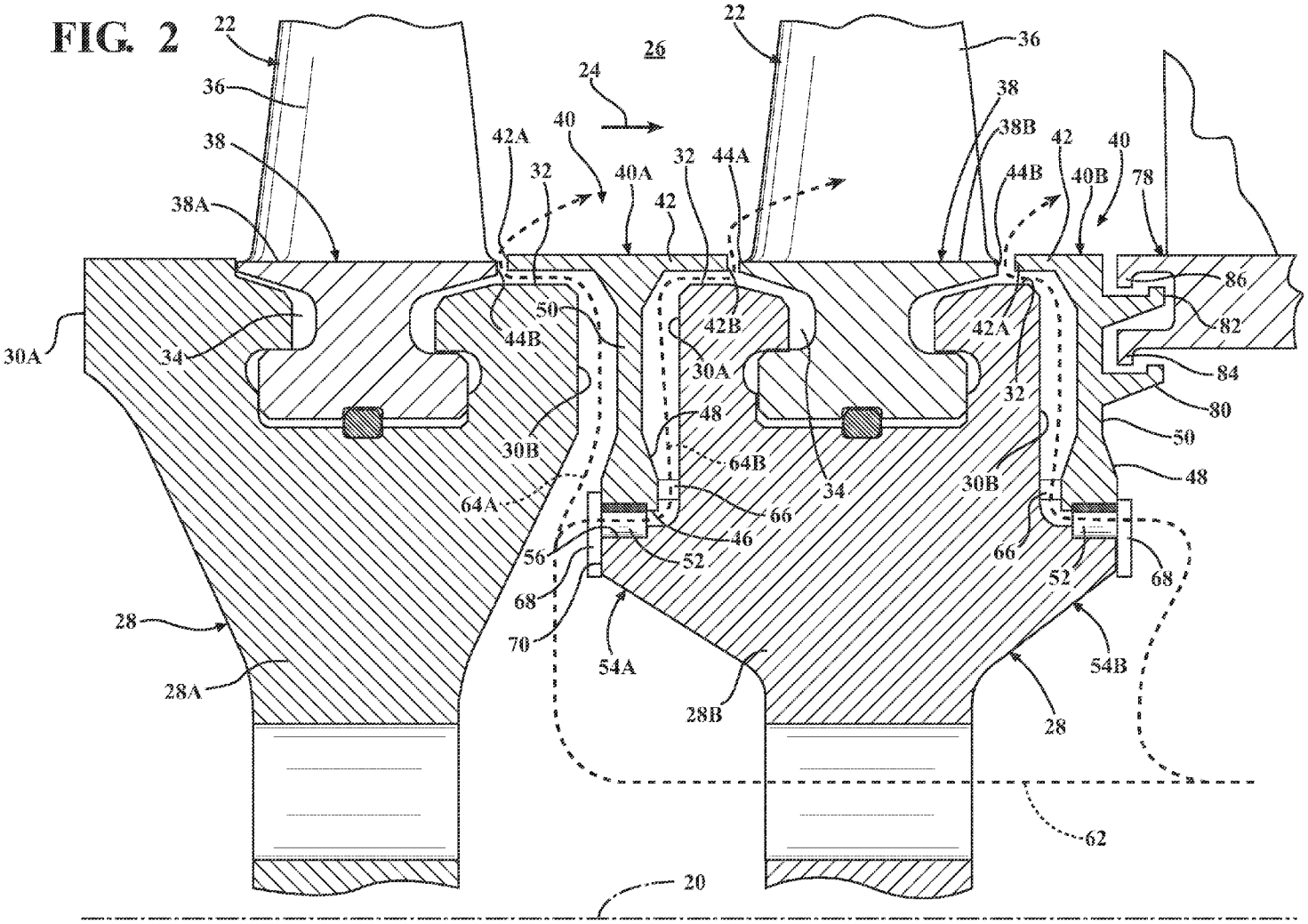
FIG. 2 is an enlarged cross-sectional view of downstream disks for a compressor of the turbine engine, illustrating aspects of the invention.

Referring additionally to FIG. 2, the rotor 10 is formed in the compressor section 12 by a plurality of disks 28 positioned adjacent to each other in the axial direction Aspects of the present invention will be described below with specific reference to the last two disks 28 of the compressor section 12, identified as 28A, 28B However, it should be understood that the present invention in not limited to the particular described rotor location and described turbomachine, and the invention can be located at a section of the rotor in another part of the engine or in another type of turbomachine.

As seen in FIG. 2, each disk 28 includes opposing axially facing upstream and downstream surfaces 30A, 30B, respectively. A circumferentially extending outer surface 32 is located between the axially facing surfaces 30A, 30B and faces radially outward toward the flow path 26 A slot 34 may be formed radially into each disk 28 at the outer surface 32, and the blades 22 can be secured into the disks 28 at the slots 34, to define a row of blades 22 mounted to each disk 28. The blades 22 can comprise an airfoil 36 that extends radially into the flow path 26 In the illustrated embodiment, the blades comprise an airfoil 36, and a platform 38 located at the radially inner end of each blade 22 that extends axially in overlapping relation over at least a portion of the outer surface 32, axially upstream and downstream of a respective slot 34, and the platform can form a part of an inner boundary for the flow path 26.

A separate thermal barrier structure 40 is provided between at least some of the adjacent disks 28, and is depicted specifically with the downstream adjacent disks 28A, 28B, also identified as first and second disks 28A, 28B. In accordance with an aspect of the invention, the thermal barrier structure 40 is depicted as including an upstream, non-segmented circumferentially continuous ring structure 40A between the adjacent disks 28A, 28B, see also FIG. 3. The ring structure 40A includes an outer rim 42 defining a thermal barrier extending between adjacent rows of blades 22 and, in the particular illustrated embodiment, the outer rim 42 extends axially from a downstream circumferentially extending edge 44B of a first platform 38A on a blade row associated with the first disk 28A to an upstream circumferentially extending edge 44A of a second platform 38B on a blade row associated with the adjacent second disk 28B. The outer rim 42 overlaps a portion of the outer surfaces 32 of two adjacent disks 28 and includes opposing circumferentially extending axial edges 42A, 42B located adjacent to the blades 22, depicted as respective edges 44B, 44A of the platforms 38A, 38B.

The ring structure 40A additionally includes a radially inner side 46 formed by a radially inner circumferential portion defining a foot portion 48. The foot portion 48 is connected to the outer rim by a radially extending web 50. The web 50 is connected to the outer rim 42 at a central location between the edges 42A, 42B to define a generally T-shaped cross-section for the ring structure 40A The T-shaped cross-section preferably configures the ring structure 40A as balanced for centrifugal forces in the axial direction to avoid distortion of the outer rim 42 during operation, such as to avoid distortion of the outer rim 42 into a conical shape as a result of unbalanced centrifugal forces at the connection with the web 50.

The ring structure 40A is preferably formed from a different material than that of the disks 28. That is, the disks 28 may be formed of a first material and the ring structure 40A may be formed of a second material that has a higher heat resistance than the first material and that can shield the outer surfaces 32 of the disks 28 from the temperature of a hot gas passing through the flow path 26 For example, the disks 28 may be formed of a ferritic steel material and the ring structure 40A may be formed of a superalloy, such as a nickel-based superalloy material. Hence, the relatively smaller volume of the more expensive superalloy material may be used to form the thermal barrier defined by the ring structure 40A, and the relatively larger volume of the disks 28 may be comprised of the less expensive ferritic steel material.

It may be understood that as a result of the ring structure 40A being formed out of a different material and with a different structural configuration than the disks 28, thermal or structural movement, such as circumferential expansion, of the ring structure 40A can differ from that of each of the adjacent disks 28. In accordance with a further aspect of the invention, the ring structure 40A is non-rigidly supported to only one of the disks 28 by a compliant interface structure, and in the illustrated embodiment is located relative to the second disk 28B by a compliant interface structure. In particular, the ring structure 40*a* can be supported on the second disk 28B by a compliant interface structure comprising a compliant element 52 located between the radially inward facing inner side 46 of the ring structure 40A and a radially outward facing side of the disk 28B defined by a circumferential upstream flange structure 54A that extends axially from the upstream axially facing surface 30A of the disk 28B. The flange structure 54A, as defined herein, can comprise an axially extending surface formed on a disk 28 that faces in the radial direction. The compliant element 52 can permit limited movement of the ring structure 40A relative to the outer surfaces 32 of the adjacent disks 28A, 28B, such as may be caused by a different thermal expansion and differential radial strain due to rotation loads resulting in a change of the circumference of the outer rim 42 relative to the circumference(s) defined by the outer surfaces 32 of the adjacent disks 28A, 28B.

Figure 3:
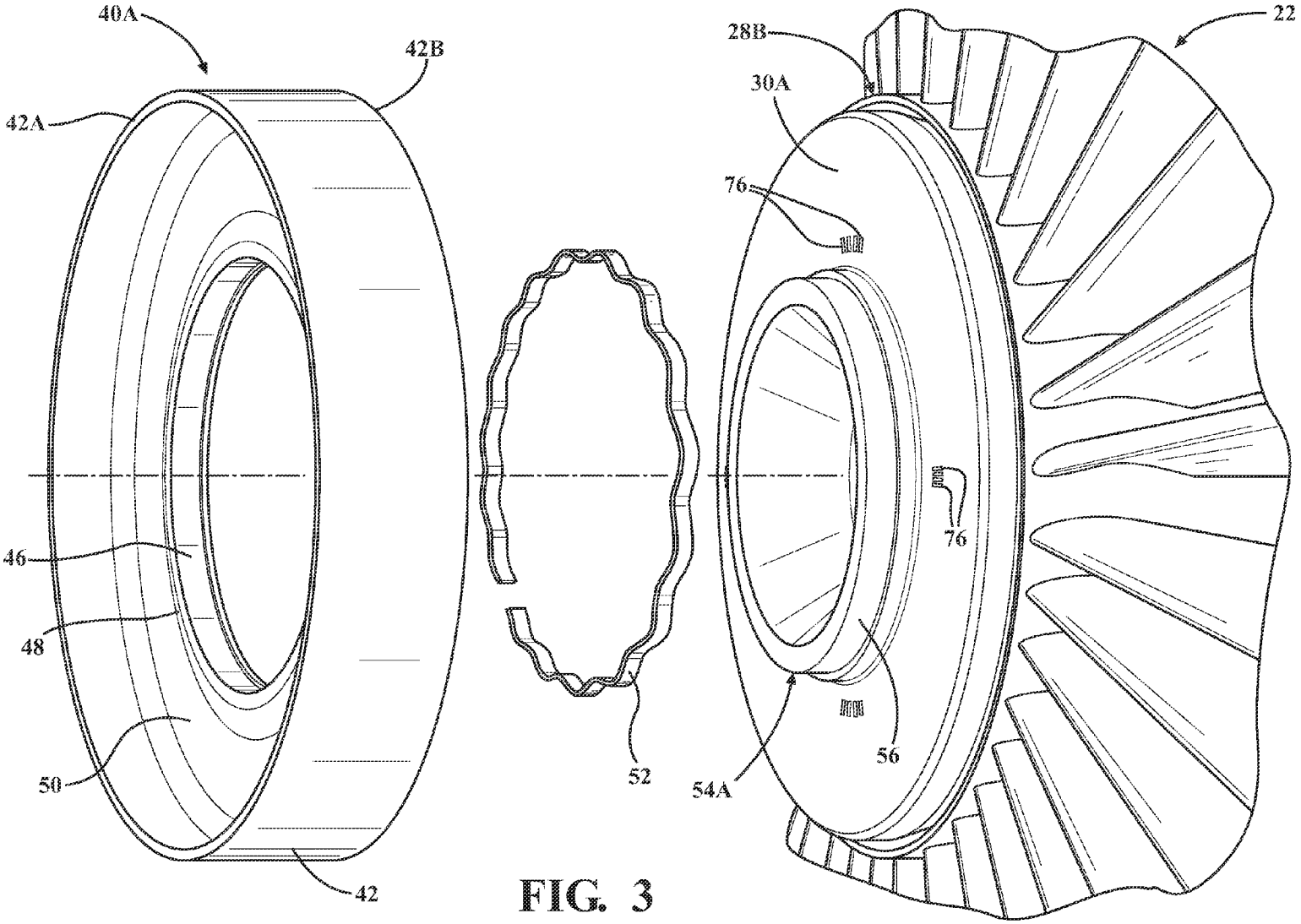
FIG. 3 is an exploded perspective view illustrating aspects of the invention.
Figure 4:
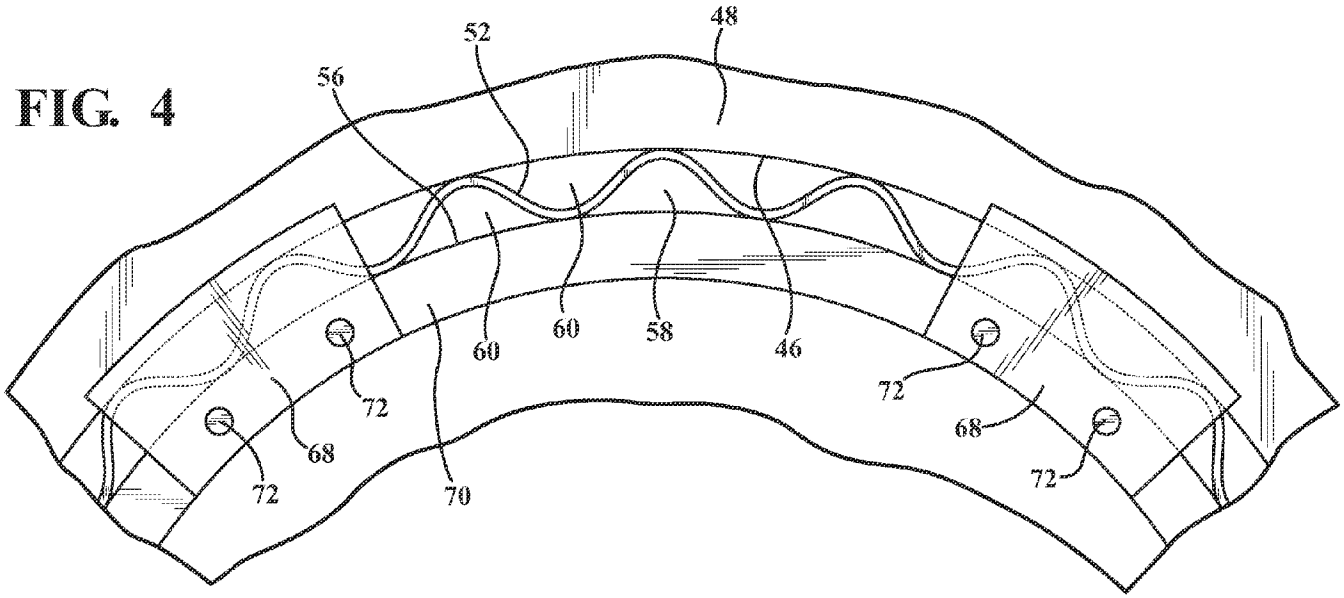
FIG. 4 is an elevation view showing an axial face of a disk including aspects of the invention.

Referring to FIGS. 3 and 4, the compliant element 52 is preferably formed of a resilient material, and can be formed by an annular elastic element, such as a circular wave spring (otherwise known in the art as a "Marcel expander"). The compliant element 52 is positioned around and supported on a radially outer surface 56 of the flange structure 54A, and provides a resilient support extending within a gap 58 between the radially inner side 46 of the ring structure 40A and the radially outer surface of the flange structure 54A Hence, the compliant element 52 can permit transient and steady-state radial displacement of the outer rim 42 of the ring structure 40*a* independently of the adjacent disks 28A, 28B, and provides a reduced contact force with a corresponding reduced stress to both the outer rim 42 and the disks 28A, 28B It may also be noted that, since the ring structure 40A is mounted to only one of the adjacent disks 28A, 28B, a load path is not created between the adjacent disks 28A, 28B, permitting a greater degree of freedom between the disks 28A, 28B for movement in both the radial direction and the axial direction.

As seen in FIG. 4, the non-rigid mounting of the ring structure 40A to the disk 28B additionally permits cooling air to flow axially between the foot portion 48 and the flange structure 54A. In particular, the compliant element 52 defines passages 60 that are maintained between the undulations of the wave spring. Cooling air can be provided from a radially inner location, such as from an upstream location adjacent to the middle section 14 of the rotor 10, as depicted by cooling air flow 62 in FIG. 2 The web 50 is located in spaced relation to each of the adjacent axially facing surfaces 30A, 30B, and the cooling air can flow radially outward along either side of the web 50, from the foot portion 48 to the outer rim 42. A first portion 64A of the cooling air can flow generally directly radially outward along one side of the web 50, and a second portion 64B of the cooling air can pass axially through the passages 60 to flow radially outward along the other side of the web 50, between the web 50 and the axially facing surface 30A. The first and second portions 64A, 64B of cooling air flows radially outward through gaps between the edges 42A, 42B of the outer rim 42 and the blades 22 to provide cooling to the blade surfaces at the rim edges 42A, 42B. In the particular illustrated embodiment, the cooling air can flow out between the rim edges 42A, 42B and the respective edges 44B, 44A of the first and second platforms 38A, 38B into the gas flow path 26 of the compressor section 12, providing cooling to the outer surfaces of the platforms 38A, 38B adjacent to the outer rim 42.

It may be understood that, since the ring structure 40A is a continuous ring, i e., a 360° structural ring, assembly of the ring structure 40A to the disk 28B requires that it be mounted through axial placement onto the flange structure 54A during assembly of the disks 28 forming the rotor 10. That is, mounting the ring structure 40A comprises moving the ring structure 40A axially onto the flange structure 54A toward the axially facing surface 30A As seen in FIG. 2, the foot portion 48 includes axial extension portions 66 that engage the axially facing surface 30A to space the web 50 from the axially facing surface 30A. In addition, the ring structure 40A can be maintained on the flange structure 54A by circumferentially spaced retention plates 68, see also FIG. 4, that may be detachably fastened to the disk 28B, and in the illustrated embodiment, can be fastened to an axial end 70 of the flange structure 54A by fasteners, such by as bolts 72.

The extension portions 66 are preferably discrete elements that are located at circumferentially spaced locations around the foot portion 48. By providing both the retention plates 68 and the extension portions 66 as discontinuous or spaced elements, openings are defined for passage of the cooling air in the axial direction past the retention plates 68 into the gap 58 and radially outward past the extension portions 66.

Figure 5:
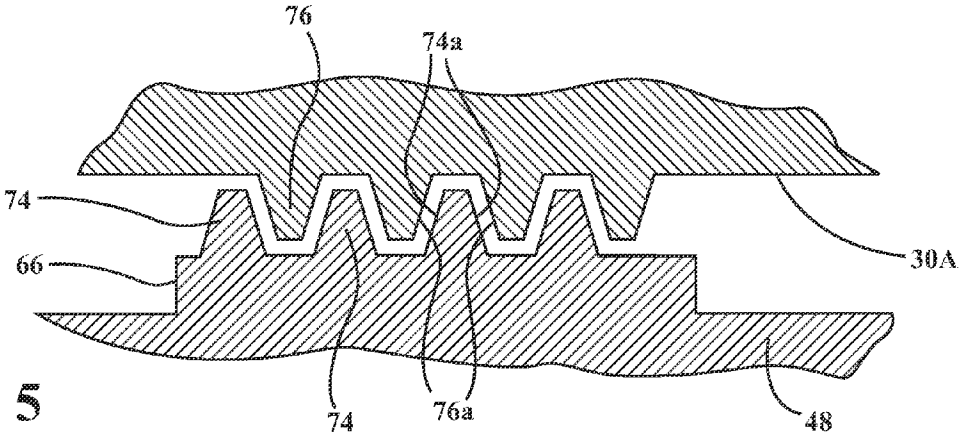
FIG. 5 is a cross-sectional radial view of an anti-rotation feature in accordance with aspects of the invention.

Referring to FIG. 5, the extension portions 66 may additionally comprise anti-rotation features for cooperating with corresponding features on the axially facing surface 30A. For example, each extension portion 66 can be formed as a plurality of ridges or teeth 74 cooperating with corresponding ridges or teeth 76 formed on the axially facing surface 30A. In the illustrated embodiment, it can be seen the locations of the cooperating teeth 74, 76 may be spaced circumferentially, such as spaced 90°, around the axially facing surface 30A (FIG. 3). Since, the ring structure 40A is non-rigidly supported on the flange structure 54A, the ring structure 40A could freely rotate relative to the disk 28B without the presence of the anti-rotation feature. The cooperating teeth 74, 76 include respective circumferentially facing surfaces 74*a*, 76*a* that engage each other to ensure that the ring structure 40A rotates with the disk 28B, without restricting radial movement, e g., thermal movement, of the ring structure 40A relative to the disk 28B.

Referring to FIG. 2, the disk 28B can comprise a last disk 28 in the compressor section 12 and is located adjacent to a stationary compressor outlet structure 78. A circumferential downstream flange structure 54B extends from the downstream axial facing surface 30B, and the thermal barrier structure 40 can further include a downstream, non-segmented circumferentially continuous ring structure 40B associated with the downstream flange structure 54B.

The ring structure 40B can be formed similar to the ring structure 40A and includes a foot portion 48 joined to an outer rim 42 by a web 50. The ring structure 40B can be maintained in position relative to the flange structure 54B by a compliant element 52, such as a circular wave spring. Additionally, the ring segment 40B can be maintained in position by retention plates 68 and can include extension portions 66 formed as a circumferentially discontinuous element and incorporating anti-rotation features, as described above for the ring structure 40A.

The outer rim 42 of the ring structure 40B extends forward in overlapping relation over a portion of the outer surface 32 of the disk 28B to provide thermal protection to the outer surface 32 As described above for the ring structure 40A, cooling air can pass through the compliant element 52, between the foot portion 48 and the flange structure 54B, and then radially outward between the downstream axially facing surface 30B and the web 50 to provide a cooling air flow through a gap between the outer rim 42 and the blade 22. In particular, in the illustrated embodiment, the cooling air can pass between an upstream edge 44A of the outer rim 42 and a downstream edge 44B of a platform 38B for the blade row on the disk 28B.

Additionally, in the illustrated embodiment, the downstream side of the web 50 for the ring structure 40B can be provided with a pair of radially spaced flange members 80, 82 located adjacent to cooperating seal structure 84, 86 on the outlet structure 78. The flange members 80, 82 and cooperating seal structure 84, 86 form a labyrinth seal for limiting passage of cooling air at the downstream side of the ring structure 40B.

Figure 6:
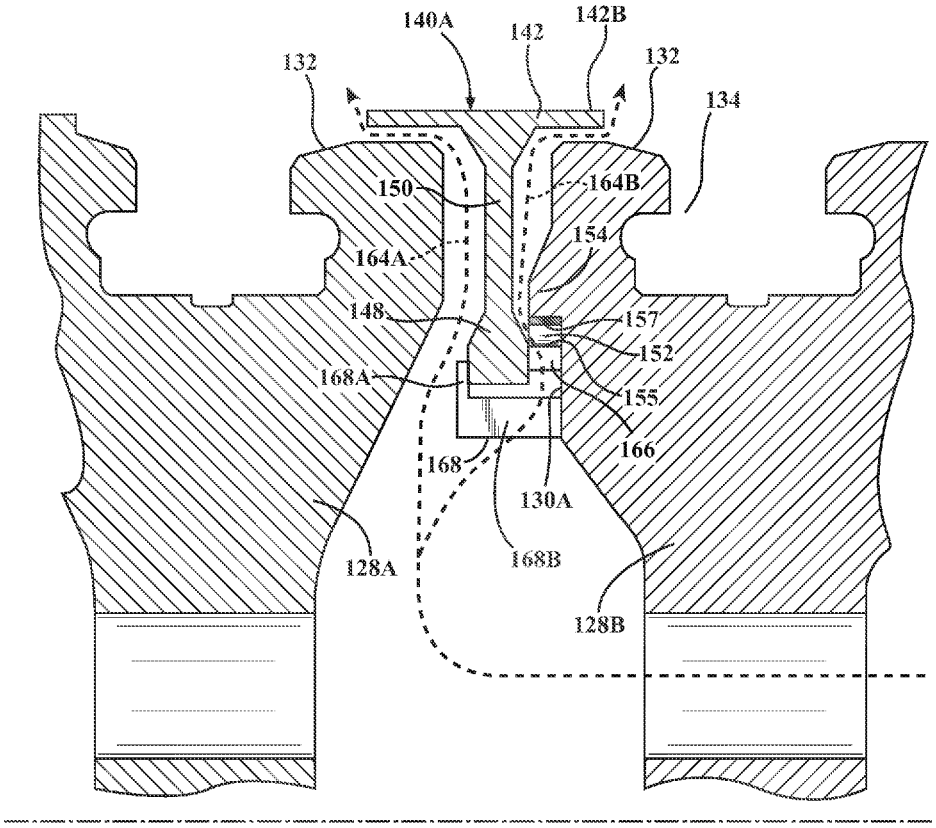
FIG. 6 is an enlarged cross-sectional view similar to FIG. 2 showing an alternative configuration illustrating aspects of the invention.

Referring to FIG. 6, an alternative configuration of the invention is illustrated in which elements corresponding to elements described above with reference to FIGS. 2-5 are identified with the same reference numerals increased by 100. In the embodiment of FIG. 6, the ring structure 140A is positioned to the disk 128B by cooperation between the foot portion 148 at a radially inner circumferential portion of the ring structure 140A and a flange structure 154 located radially outward from the foot portion 148. Specifically, a compliant element 152, e.g., a circular wave spring, can be positioned between a radially outward facing side 155 of an axial extension portion 166 of the foot portion 148 and a radially inward facing surface 157 of the flange structure 154 to locate the ring structure 140A in the radial direction relative to the disk 128B.

The ring structure 140A can be axially retained to the disk 128B by a plurality of circumferentially spaced retention plates 168. In accordance with an aspect of the invention, each retention plate 168 can include a radial portion 168A for engaging an axial face of the foot portion 148, and an axial portion 168B extending across the inner side of the foot portion 148 to engagement with the disk 128B, where the axial portion 168B can be detachably fastened to the disk 128B It may be noted that the axial portion 168B preferably extends in radially spaced relation to the foot portion 148 to avoid a rigid radial restraint between the disk 128B and the ring structure 140A.

The axial extension portions 166 and retention structures 168 are preferably circumferentially spaced along the axially facing surface 130A, i e, form circumferentially discontinuous structures, to permit cooling air to flow radially outward to pass through the compliant element 152 and between the web 150 and the axially facing surface 130A, as depicted by air flow 164B At the radially outer end of the web 152, the cooling air can pass between the outer rim 142 and the outer surface 132 of the disk 128B, and further pass between the edge 142B of the outer rim 142 and a blade (not shown in FIG. 6) In addition, it may be understood that a downstream rib structure similar to the rib structure 40B may be provided associated with the disk 128B, and including a compliant interface structure similar to the interface described for the ring structure 140A.

While particular embodiments of the present invention have been illustrated and described, it would be obvious to those skilled in the art that various other changes and modifications can be made without departing from the spirit and scope of the invention It is therefore intended to cover in the appended claims all such changes and modifications that are within the scope of this invention.

What is claimed is:

1. A turbomachine comprising:

a rotor having an axis and a plurality of disks positioned adjacent to each other in an axial direction, each disk including opposing axially facing surfaces;

at least one row of blades positioned on each of the plurality of disks, each row of blades extending radially outward from a radially facing surface of a respective disk of the plurality of disks;

a circumferentially continuous ring structure defining a thermal barrier extending axially between and overlapping the radially facing surfaces of two adjacent disks of the plurality of disks;

a compliant element comprising an annular elastic element located between a radially inner circumferential portion of the ring structure and an axially extending flange structure of one of the two adjacent disks, wherein the ring structure has an outer axially extending rim, a radially inner foot portion forming the radially inner circumferential portion of the ring structure, and a radially extending web that is axially narrower than the foot portion and forms a connection between the rim and the foot portion wherein the compliant element movably supports the foot portion to the flange structure;

a retention plate structure detachably fastened to the disk to engage the foot portion for axially retaining the ring structure to the flange structure, wherein the foot portion includes an axial extension for engagement with one of the axially facing surfaces of the plurality of disks, wherein the axial extension forms an anti-rotation feature having circumferentially facing surfaces boated in engagement with cooperating circumferentially facing surfaces formed on a facing surface of the disk; and axially extending aft passages through the compliant element providing passage of air between the foot portion and the flange structure, and the ring structure including an outer rim haying edges boated adjacent to edges of the blades, wherein a gap is defined between the adjacent edges of the outer rim and the blades for passage of a cooling air flow from a radially inner to a radially outer location relative to the outer rim.

2. The turbomachine of claim 1, wherein the compliant element is a circular wave spring.

3. The turbomachine of claim 1, wherein the disks are formed of a first material and the ring structure is formed of a second material, which shields the radially facing surfaces of the disks from the temperature of a hot gas passing through an axial gas flow path containing the blades, and the second material having a higher heat resistance than the first material.

4. The turbomachine of claim 1, wherein the compliant element is located at one of:

between a radially inward facing side of the ring structure and a radially outward facing side of the flange structure; and between a radially outward facing side of the ring structure and a radially inward facing side of the flange structure.

* * * * *